US007832572B2

(12) United States Patent
Wyatt et al.

(10) Patent No.: US 7,832,572 B2
(45) Date of Patent: Nov. 16, 2010

(54) FLUE SYSTEM FOR STORAGE RACKS

(75) Inventors: Philip D. Wyatt, Neosho, MO (US); Rodney R. Garringer, Lamar, MO (US)

(73) Assignee: L&P Property Management Company, South Gate, CA (US)

( * ) Notice: Subject to any disclaimer, the term of this patent is extended or adjusted under 35 U.S.C. 154(b) by 917 days.

(21) Appl. No.: 11/670,641

(22) Filed: Feb. 2, 2007

(65) Prior Publication Data

US 2007/0175371 A1 Aug. 2, 2007

Related U.S. Application Data

(60) Provisional application No. 60/764,726, filed on Feb. 2, 2006.

(51) Int. Cl.
*A47B 57/00* (2006.01)

(52) U.S. Cl. ..... 211/189; 211/181.1; 211/191

(58) Field of Classification Search ..... 211/189, 211/191, 41.15, 41.16, 180, 181.1
See application file for complete search history.

(56) References Cited

U.S. PATENT DOCUMENTS 3,899,836 A * 8/1975 Johnson ..... 34/225
4,444,322 A * 4/1984 Lee ..... 211/190
4,660,799 A * 4/1987 Butland ..... 248/676
5,160,294 A 11/1992 Petter
5,170,829 A * 12/1992 Duncan et al. ..... 160/84.02
5,806,417 A * 9/1998 Whiten et al. ..... 108/106
6,520,357 B1 * 2/2003 Kautz et al. ..... 211/191
6,585,122 B2 * 7/2003 Calleja ..... 211/183
6,722,512 B2 * 4/2004 Scully ..... 211/183
6,729,083 B1 * 5/2004 Soyko ..... 52/220.8
6,739,463 B2 * 5/2004 Wishart et al. ..... 211/189

* cited by examiner

*Primary Examiner*—Korie Chan
(74) *Attorney, Agent, or Firm*—Michael Best & Friedrich LLP

(57) ABSTRACT

A storage rack includes at least one first support beam at a first end of the storage rack and at least one second support beam at a second, opposite end of the storage rack wherein the support beams are spaced apart to define a storage area. A flue system for use with the storage rack includes first and second brackets. The first bracket is coupled to the first support beam and the second bracket is coupled to the second support beam. The first side panel extends between the first and second ends of the storage rack, and includes a first end removably coupled to the first bracket and a second end removably coupled to the second bracket. A second side panel extends between the first and second ends of the storage rack, and includes a first end removably coupled to the first bracket and a second end removably coupled to the second bracket. The first and second side panels are spaced apart to define a passageway extending through the storage rack.

30 Claims, 11 Drawing Sheets

FLUE SYSTEM FOR STORAGE RACKS

CROSS-REFERENCE TO RELATED APPLICATION

This application claims priority from U.S. Provisional Patent Application No. 60/764,726, entitled "Flue System for Storage Racks", filed Feb. 2, 2006 by Philip D. Wyatt and Rodney R. Garringer.

BACKGROUND

The present invention relates to a flue system for use with a storage rack.

Storage racks are oftentimes used in warehouses and similar settings, such as in the backrooms of retail stores, to store articles on pallets that are arranged in vertical columns. Likewise, articles may be stored on racks in a variety of other manners without the use of pallets. The columns are often placed close together to maximize storage space and, consequently, there is little to no space between the columns to form an air passage. Even if air passages are formed between adjacent columns, the pallets or articles may be offset or otherwise positioned so as to obstruct the air passage.

SUMMARY

In one embodiment, the invention provides a flue system for use with a storage rack. The storage rack includes at least one first support beam at a first end of the storage rack and at least one second support beam at a second, opposite end of the storage rack wherein the support beams are spaced apart to define a storage area. The flue system includes first and second brackets, with the first bracket being coupled to the first support beam and the second bracket being coupled to the second support beam. The first side panel extends between the first and second ends of the storage rack, and includes a first end removably coupled to the first bracket and a second end removably coupled to the second bracket. A second side panel extends between the first and second ends of the storage rack, and includes a first end removably coupled to the first bracket and a second end removably coupled to the second bracket. The first and second side panels are spaced apart to define a passageway extending through the storage rack.

In another embodiment the invention provides a system for conveying smoke through a storage rack. The storage rack includes at least two first support beams at a first end of the storage rack and at least two second support beams at a second, opposite end of the storage rack wherein the support beams are spaced apart to define a storage area. The system includes a first flue system removably coupled to at least one first support beam and at least one second support beam. The first flue system extends between the first and second ends of the storage rack, wherein the first flue system defines a first passageway extending through a portion of the storage rack. The system also includes a second flue system removably coupled to at least one first support beam and at least one second support beam. The second flue system extends between the first and second ends of the storage rack and the second flue system defining a second passageway extending through a portion of the storage rack. The second flue system is positioned above the first flue system such that the first passageway and the second passageway are substantially aligned to define a main passageway. Further, the system includes support means for supporting the second flue system on the first flue system. The support means are coupled to an upper end of the first flue system and are configured for supporting a lower end of the second flue system.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
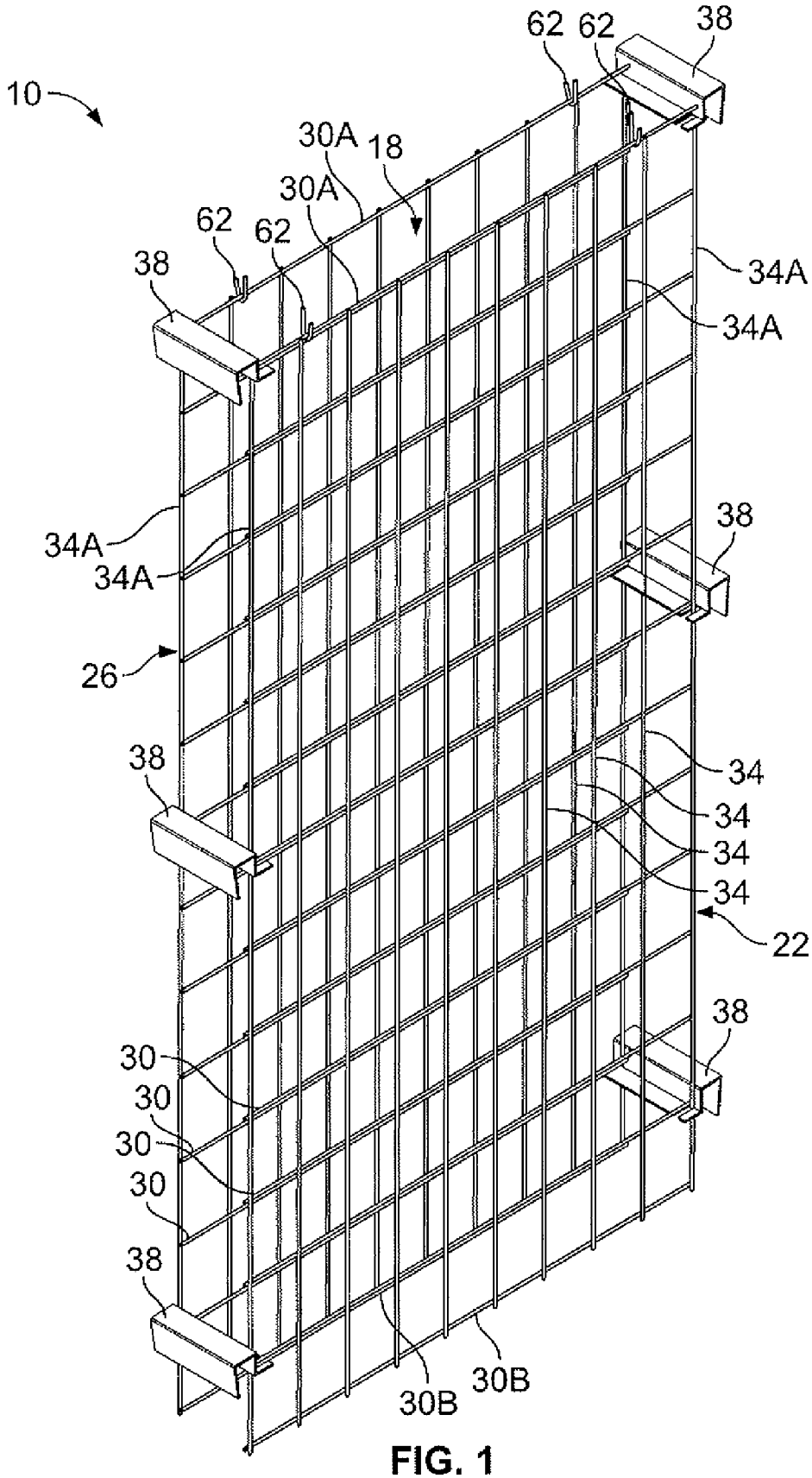
FIG. 1 is a perspective view of a flue system according to one embodiment of the invention.
Figure 2B:
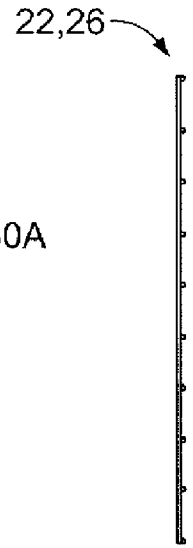
FIGS. 2A, 2B and 2C illustrate various views of a panel of the flue system.
Figure 2A:
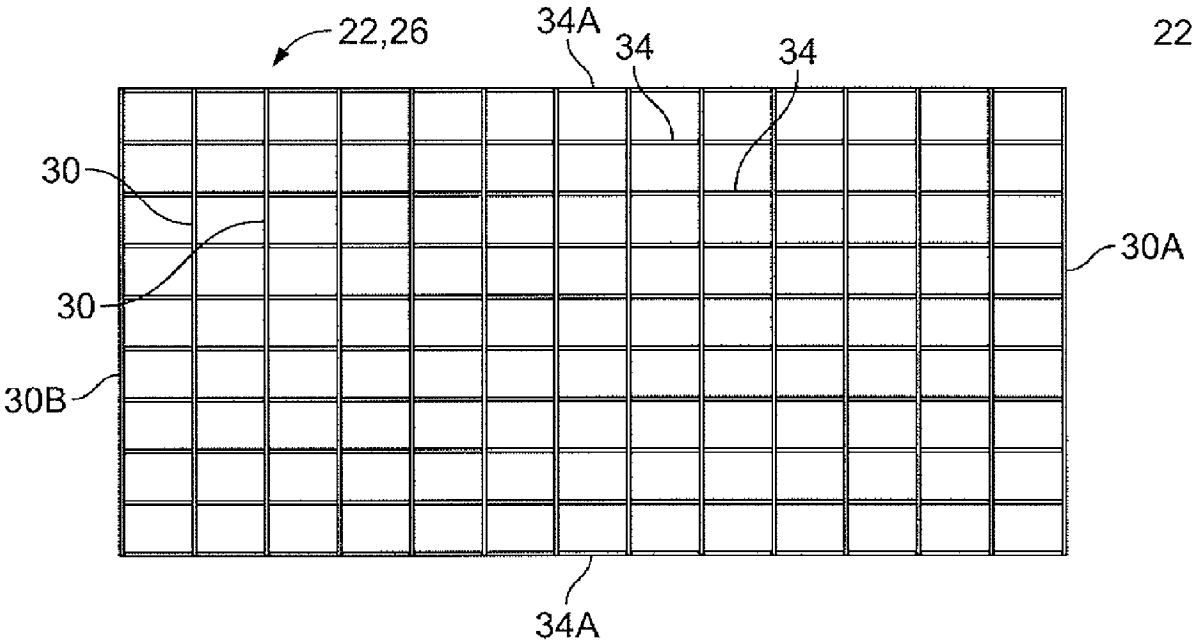
Figure 2C:
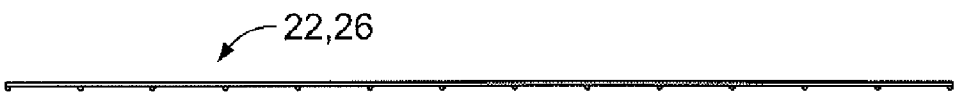
Figure 3A:
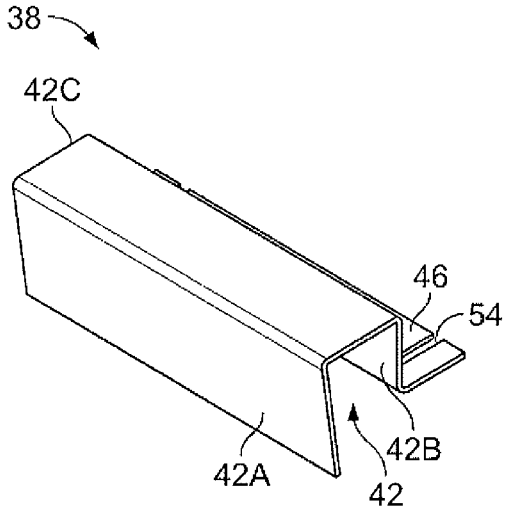
FIG. 3A illustrates a perspective view of a support bracket of the flue system.
Figure 3B:
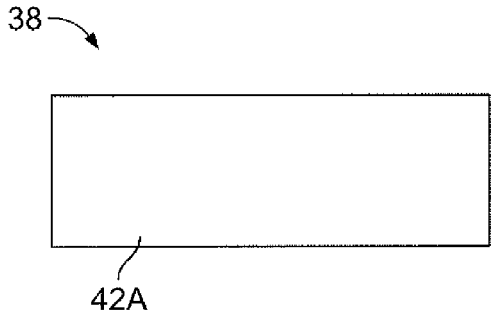
FIGS. 3B, 3C and 3D illustrate various other views of the bracket.
Figure 3C:
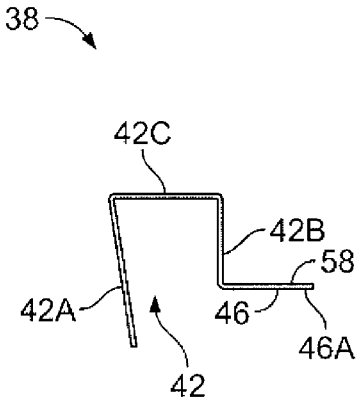
Figure 3D:
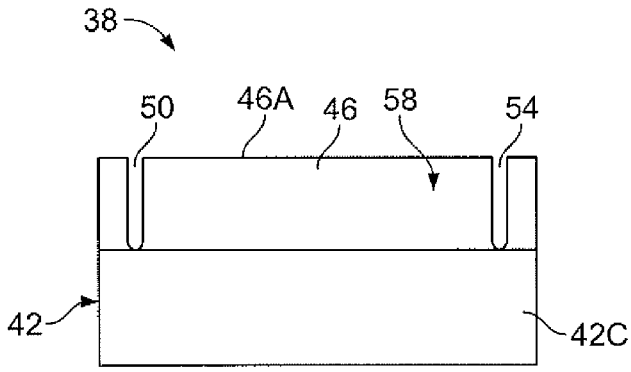
Figure 3E:
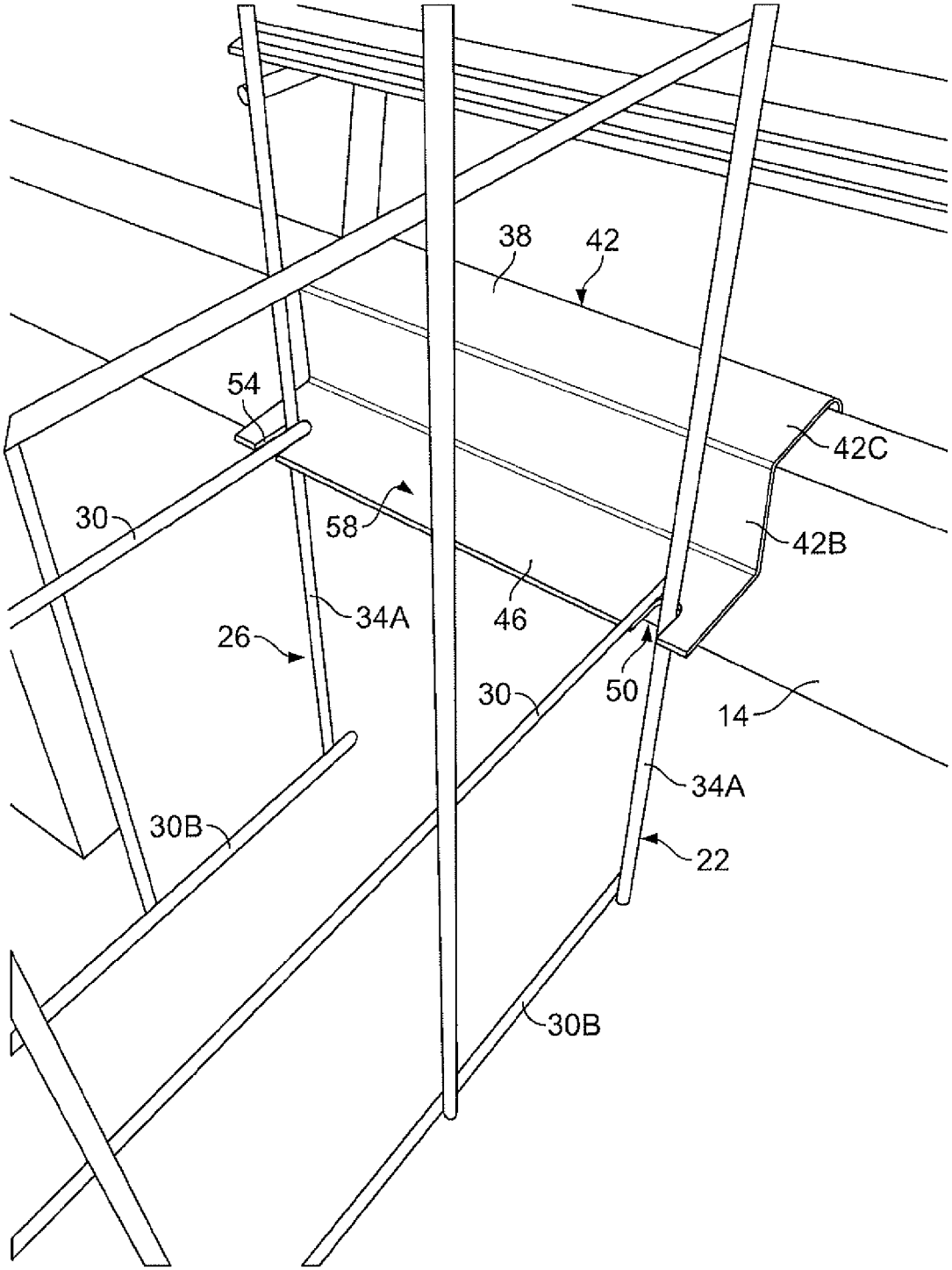
FIG. 3E illustrates the support bracket attached to a lateral beam of a storage rack and supporting the bottom of the flue system.
Figure 4A:
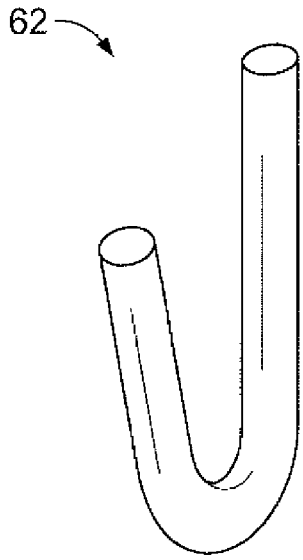
FIG. 4A illustrates a perspective view of a support hook for aligning and securing stacked flue systems.
Figure 4B:
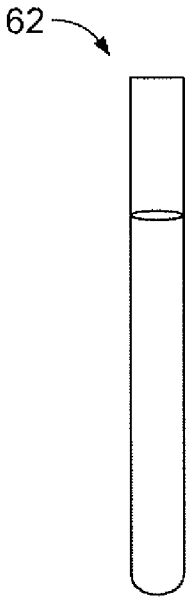
FIGS. 4B and 4C illustrate various other views of the hook.
Figure 4C:
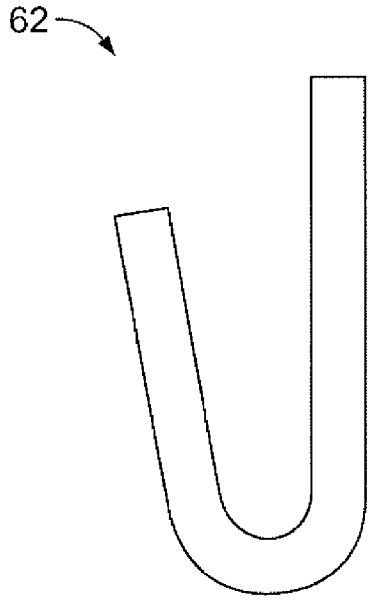
Figure 5B:
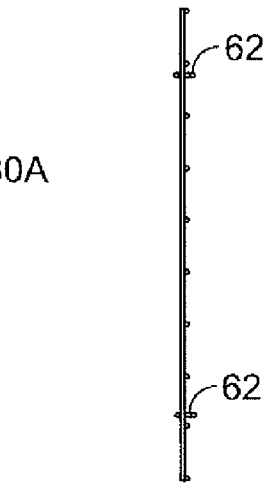
FIGS. 5A, 5B and 5C illustrate various views of the panel with attached support hooks of the flue system.
Figure 5A:
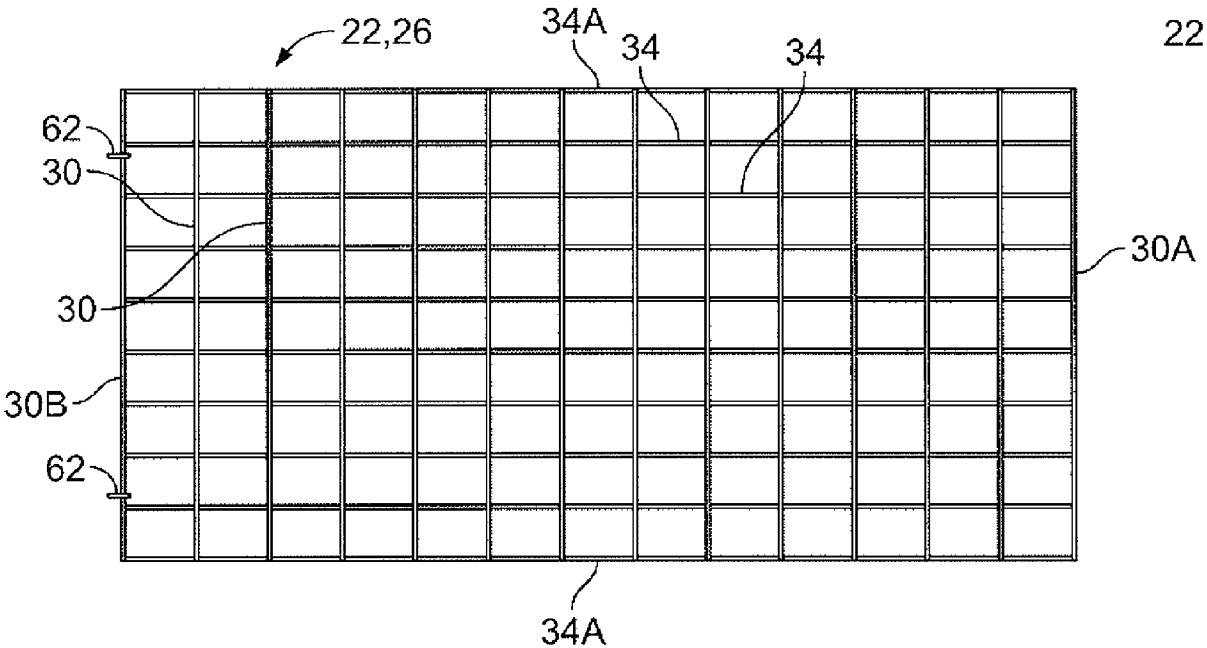
Figure 5C:
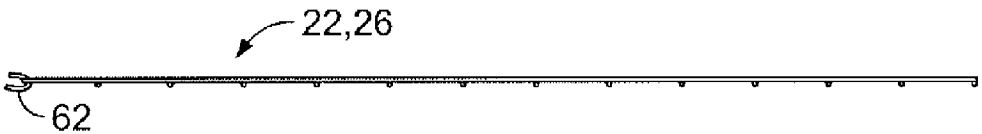

FIG. 1 illustrates a flue system 10 according to one embodiment of the present invention, and FIGS. 2A-2C, 3A-3D, 4A-4C and 5A-5C illustrate components of the flue system 10. The flue system defines a vertical air passageway between pallet columns or other articles stored on the rack through which smoke can rise by convection to a ceiling of a warehouse or top of the rack to reach a smoke detector and trigger an alarm. The flue system 10 is mounted to lateral beams 14 (FIGS. 3E and 6-8) of a storage rack (not shown) to define a passageway 18 to convoy smoke from the storage rack up to a ceiling, or to a top of the rack. Multiple flue systems may be positioned along a length of the rack, or stacked upon one another along a height of the rack.

The flue system 10 includes a pair of spaced apart side panels 22, 26 that extend from a front to a back of the storage rack. Referring to FIGS. 1 and 2A-2C, each side panel 22, 26 is formed from a grid of interconnecting horizontal and vertical wire rods 30, 34. The rods 30, 34 are arranged to form an open grid through which gases can freely pass. The panels 22, 26 prevent articles on stacked pallets or otherwise stored on the rack (not shown) from extending into and obstructing the passageway 18. In the illustrated embodiment, each panel 22, 26 has a height of about 79 inches and a width of about 39 inches. In another embodiment, each panel 22, 26 is approximately the height of the rack.

The flue system 10 includes a number of support brackets 38 that fit over the lateral beams 14 of the storage rack to support and space apart the side panels 22, 26. In the illustrated embodiment, six support brackets 38 are used to couple the flue system 10 to the rack. Three brackets 38 are positioned at each end of the flue system 10, each bracket for coupling to a vertically adjacent lateral beam 14 of the rack. The side panels 22, 26 extend from brackets 38 positioned on one side of the rack to brackets positioned at the opposite side of the rack.

Referring to FIGS. 1, 3A-3D and 3E, each support bracket 38 forms a U-shaped portion 42 that snugly fits over the lateral beams 14 of the storage rack. The U-shaped portion 42 includes a first portion 42A that is positioned adjacent an outer surface of the lateral beam 14, a second portion 42B that is positioned adjacent an inner surface of the lateral beam 14, and a central portion 42C extending therebetween. A horizontal flange portion 46 extends outwardly from the second portion 42B of the U-shaped portion 42, i.e., generally towards a center of the storage rack. A pair of spaced apart slots 50, 54 extend from a free edge 46A of the flange portion 46 towards the second portion 42B. Each slot 50, 54 receives an outermost vertical wire rod 34A on each side panel 22, 26. The slots 50, 54 are spaced apart to maintain a pre-determined distance between the two panels 22, 26. In the illustrated embodiment, the slots 50, 54 are about 6 inches apart to thereby define a 6 inch wide passageway 18 between the two panels 22, 26. The slots 50, 54 are sized and configured to receive the vertical wire rods 34A located at the ends of each side panel 22, 26 so that when the side panels 22, 26 are placed in the bracket slots 50, 54, the horizontal wire rods 30 on the side panel 22, 26 adjacent to the bracket 38 will rest on an upper surface 58 of the flange portion 46 to support the panel 22, 26 on the bracket 38. In the illustrated embodiment, each slot 50, 54 has a width of about 0.25 inches. It should be readily apparent to those of skill in the art that the bracket 38 and slots 50, 54 may be sized and configured to accommodate any number of sized lateral beams and side panels.

The flue system 10 also includes a number of support hooks 62 that are attached to an upper horizontal rod 30A of each side panel 22, 26. The support hooks 62 receive a lower horizontal rod 30B of a flue system (not shown) stacked upon the illustrated flue system 10 to support the upper flue system and align the passageways 18 of the flue systems 10. In the illustrated embodiment, four support hooks 62 are used to support a stacked flue system. Referring to FIGS. 1, 4A-4C and 5A-5C, each support hook 62 is generally U-shaped and formed from a wire rod. In the illustrated embodiment, each hook 62 is welded to the upper horizontal rods 30A of the side panels 22, 26 with its open end facing upwardly to keep the hook 62 in position. In a further embodiment, other securing means may be used, such as glue or adhesive. Each hook 62 receives the upper horizontal rod 30A of each side panel 22, 26 of the flue system 10 and the lower horizontal rod 30B of each side panel 22, 26 of the stacked flue system. It should be readily apparent to those of skill in the art that other hook or bracket means may be used to stack a second flue system upon the illustrated flue system 10. Although two support hooks 62 are shown per side panel 22, 26 in FIGS. 1 and 5A-5C, in further embodiments, fewer or more support hooks 62 may be used with each side panel 22, 26.

Figure 6A:
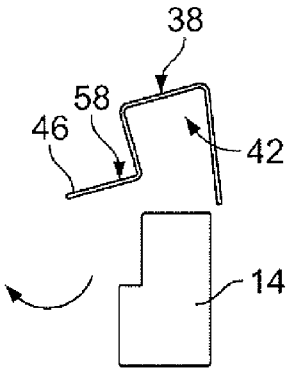
FIGS. 6, 6A-6C, 7 and 8 illustrate steps for assembling the flue system shown in FIG. 1.
Figure 6B:
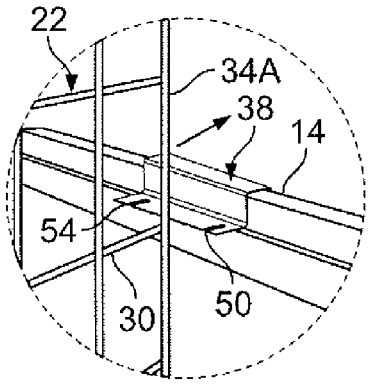
Figure 6C:
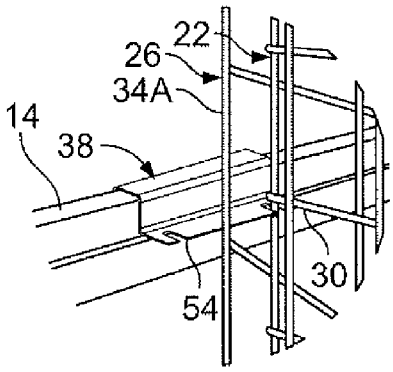
Figure 6:
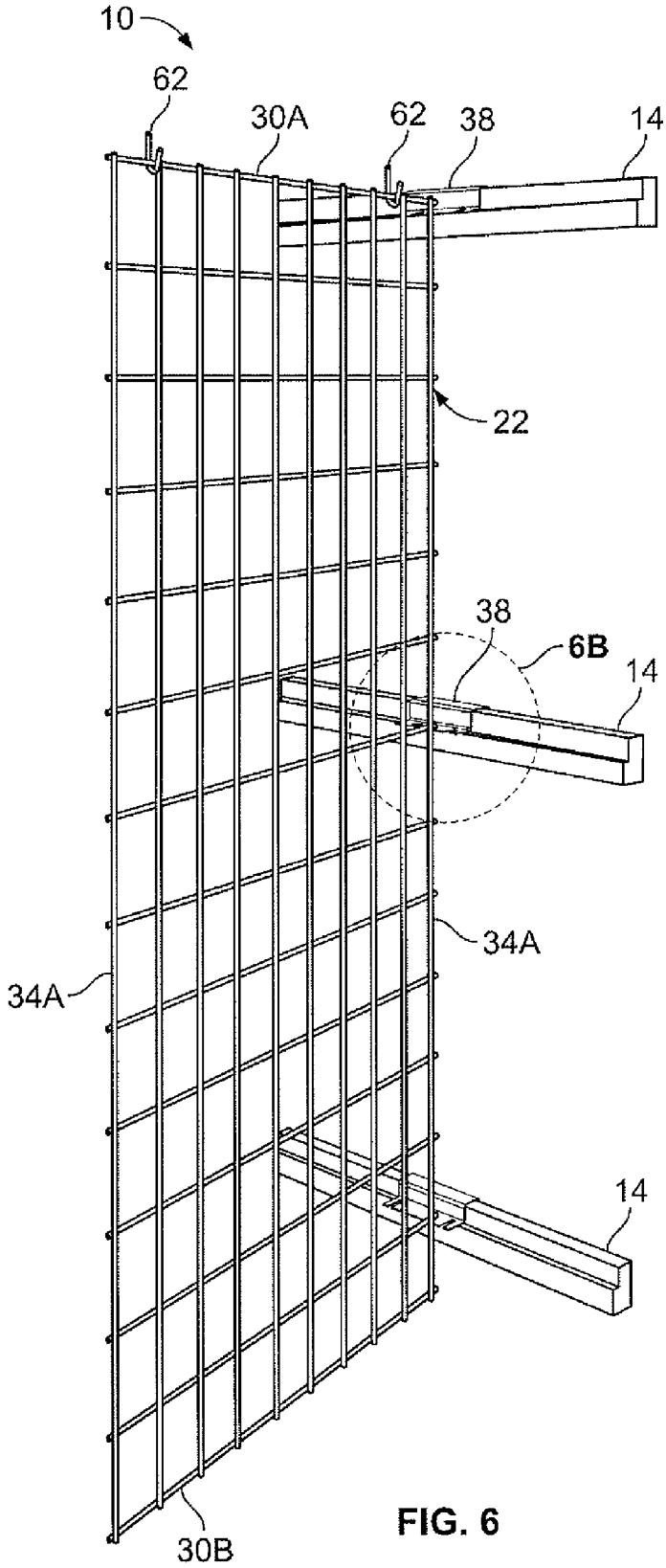
Figure 7:
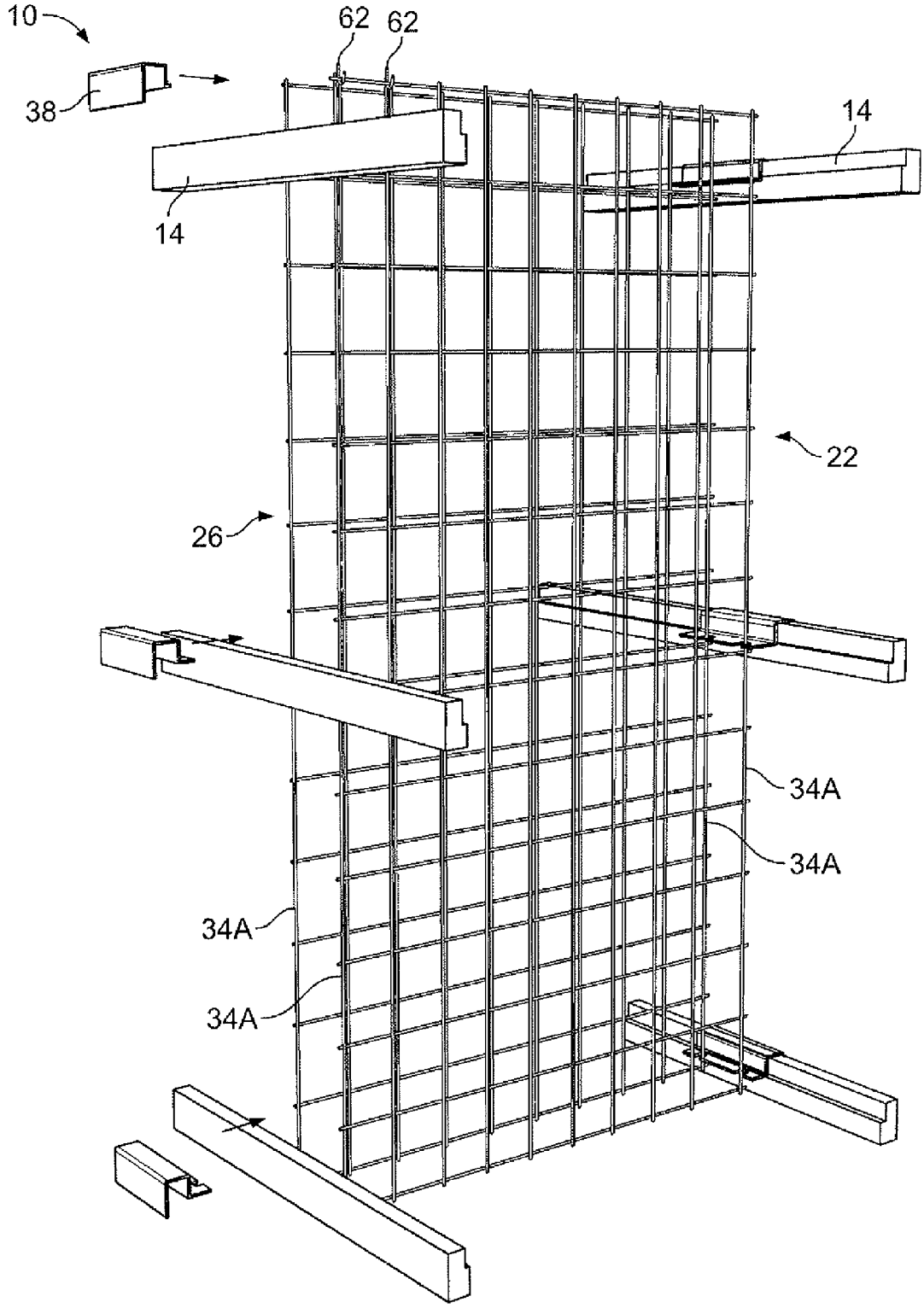
Figure 8:
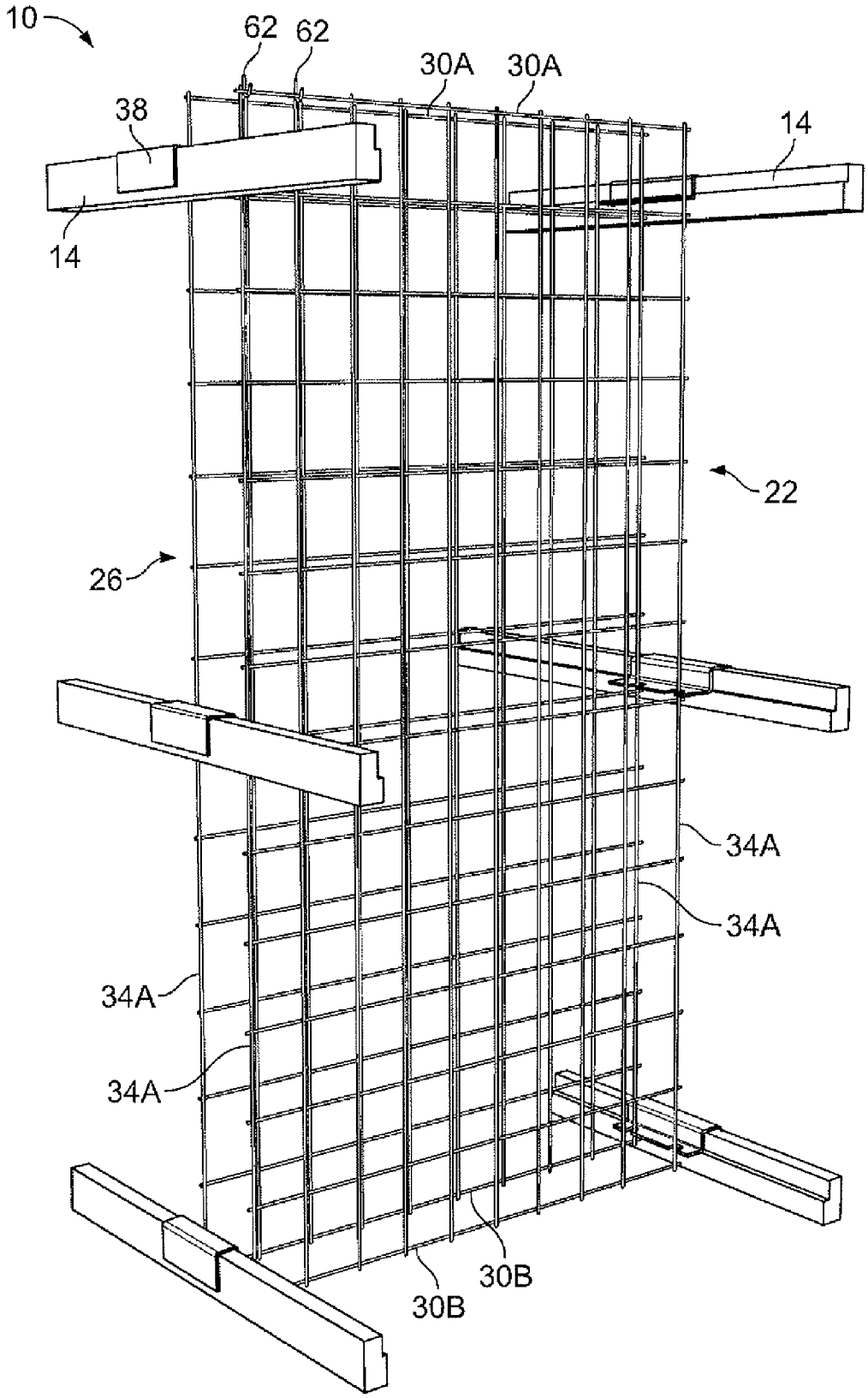

FIGS. 6-8 illustrate assembly of the flue system 10 shown in FIG. 1. Referring to FIG. 6, the support brackets 38 on one side of the flue system 10 are placed over the lateral beams 14 of the storage rack (shown in FIG. 6A as well). The U-shaped portion 42 of each bracket 38 fits over the lateral beam 14 such that the flange portion 46 extends towards a center of the storage rack. Next, an end vertical rod 34A of the first side panel 22 is inserted in the first slot 50 of each bracket 30 (shown in FIG. 6B as well) so that adjacent horizontal rods 30 of the panel 22 are positioned above each bracket 38 to be supported by the flange portion 46 (shown in FIG. 6C as well). The steps shown in FIGS. 6B and 6C are then repeated for the end vertical rod 34A of the second side panel 26 of the flue system 10.

Referring to FIG. 7, the support brackets 38 on the opposite side of the flue system 10 are then attached to the side panels 22, 26 and placed over the lateral beams 14 on the opposite side of the storage rack. The slots 50, 54 of each bracket 38 are positioned to receive the vertical end rods 34A of the side panels 22, 26. The brackets 38 are then slid downward such that the U-shaped portion 42 of each bracket 38 fits over the adjacent lateral beam 10. Adjacent horizontal rods 30 of the panels 22, 26 are positioned above each bracket 38 to be supported by the flange portion 46.

In some assemblies, a second flue system is needed to extend a height of the passageway 18 to a ceiling of the facility or at least to a top of the storage rack. The second flue system is coupled to the lower storage rack following the steps shown and described above with respect to FIGS. 6 and 7. Support hooks 62 are secured to the upper horizontal rods 30A of the side panels 22, 26 and lower horizontal rods 30B of the second flue system are seated in the hooks 62 to align the passageways 18 of the two flue systems 10.

Figure 9:
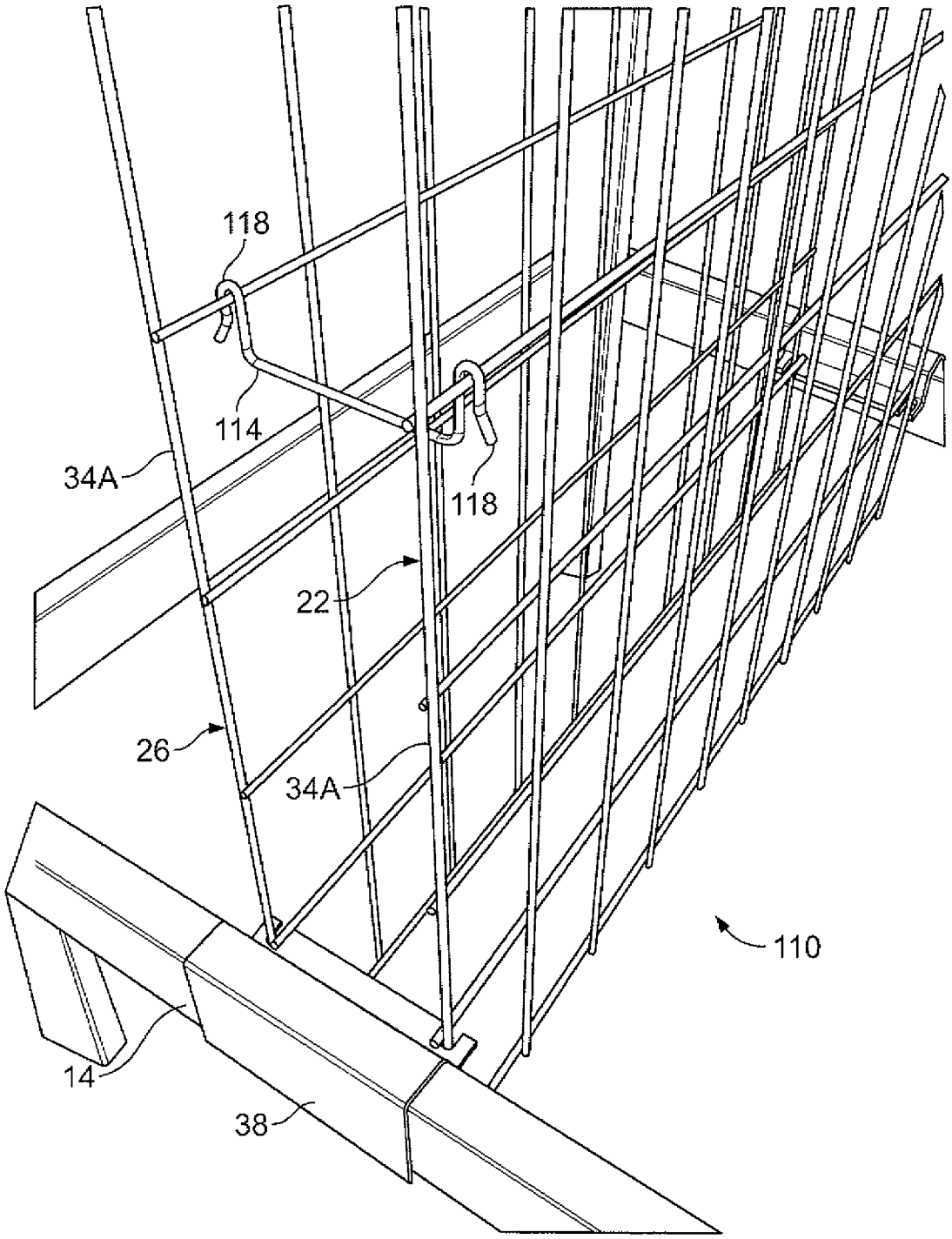
FIG. 9 illustrates a flue system according to another embodiment of the invention.

FIG. 9 shows a partial view of a flue system 110 according to another embodiment of the invention. The flue system 110 is similar to the flue system 10 shown in FIGS. 1 and 3E, and like parts are identified using the same reference numerals. The flue system 110 includes a pair of spaced apart side panels 22, 26, support brackets 38, and support struts 114. The support brackets 38 fit over lateral beams 14 of the storage rack on opposite sides of the storage rack. The side panels 22, 26 extend between the brackets 38 and are coupled to the brackets 38, as described above, such that the brackets 38 support and space apart the side panels 22, 26.

Referring to FIG. 9, the support struts 114 are placed between the side panels 22, 26 to help maintain spacing between the panels 22, 26 and provide rigidity to the flue system 110. Each support strut 114 includes hooks 118 at opposite ends of the struts 114. The hooks 118 fit over horizontal rods 30 of the opposed panels 22, 26 at selected locations along a height of the panels 22, 26. In the illustrated embodiment, the struts 114 are positioned about midway between vertically adjacent lateral beams 14.

Figure 10:
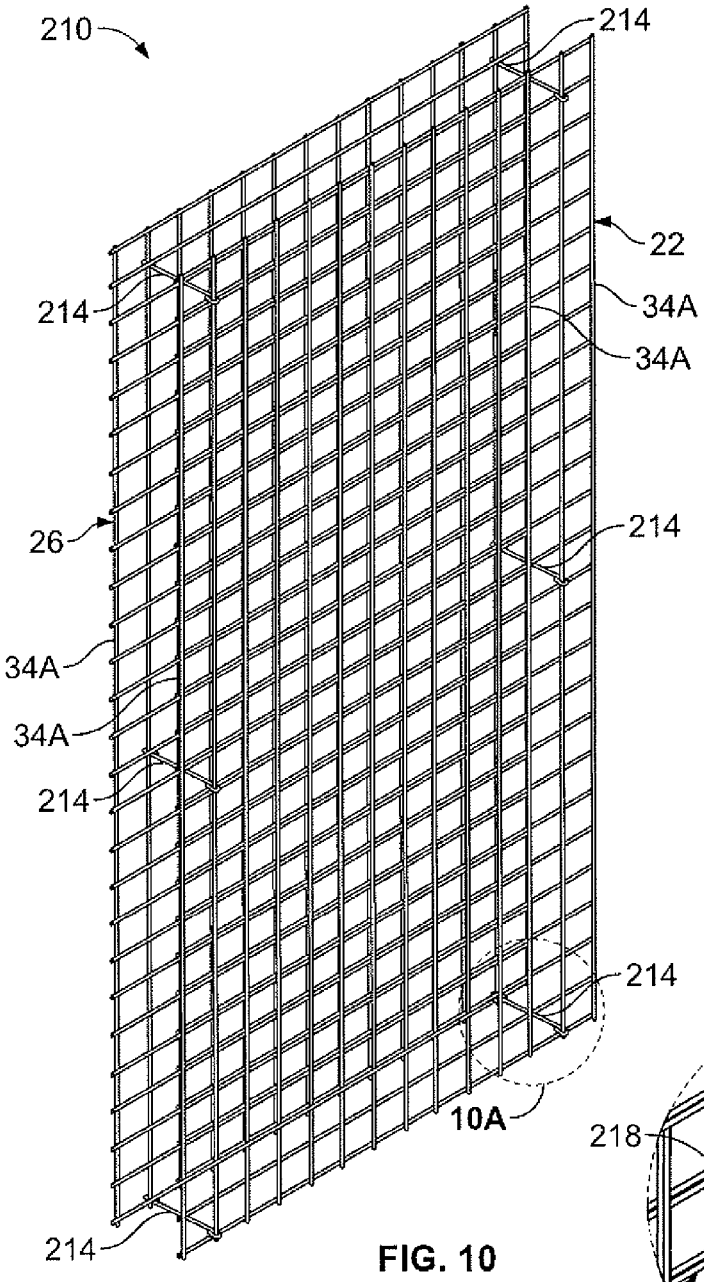
FIGS. 10 and 10A illustrate a flue system according to yet another embodiment of the invention.
Figure 10A:
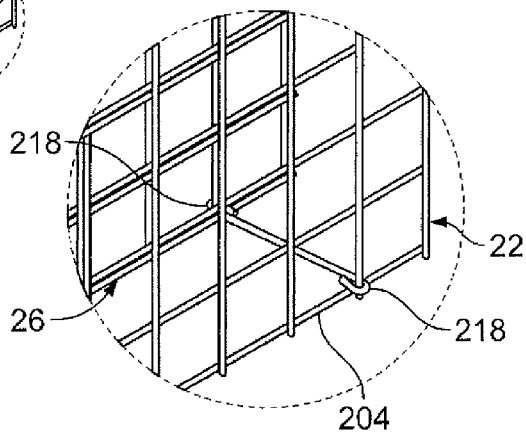

FIGS. 10 and 10A illustrate a flue system 210 according to another embodiment of the invention. The flue system 210 is similar to the flue systems 10 and 110 shown in FIGS. 1 and 9, and like parts are identified using the same reference numerals. The flue system 210 includes a pair of spaced apart side panels 22, 26, support brackets 38, and support struts 214. Referring to FIG. 10, the support struts 214 are placed between the side panels 22, 26 to help maintain spacing between the panels 22, 26 and provide rigidity to the flue system 210. Each support strut 214 includes ends 218 that are bent, or curled, around horizontal rods 30 of the opposed panels 22, 26 at selected locations along a height of the panels 22, 26. In the illustrated embodiment, the struts 214 are positioned about midway between vertically adjacent lateral beams 14. The struts are permanently attached to the side panels 22, 26 and form a hinge. Therefore, the flue system 210 may be folded flat for transport and storage.

It should be readily apparent to those of skill in the art that the flue systems 110 and 210 shown in FIGS. 9 and 10 are fabricated in the same manner disclosed in FIGS. 6-8.

It is to be understood that the invention is not limited in its application to the details of the construction and the arrangements of the components set forth in the above description or illustrated in the drawings. The invention is capable of other embodiments and of being practiced or carried out in various ways which are still within the spirit and scope of the present invention. Also, it is understood that the phraseology and terminology used herein is for the purpose of description and should not be regarded as limiting. Various features and advantages of the invention are set forth in the following claims.

What is claimed is:

1. A flue system for use with a storage rack, the storage rack including at least one first support beam at a first end of the storage rack and at least one second support beam at a second, opposite end of the storage rack, the support beams spaced apart to define a storage area, the flue system comprising:

first and second brackets, the first bracket coupled to the first support beam and the second bracket coupled to the second support beam;

a first side panel extending between the first and second ends of the storage rack, the first side panel including a first end removably engaged with the first bracket and a second end removably engaged with the second bracket; and a second side panel extending between the first and second ends of the storage rack, the second side panel including a first end removably engaged with the first bracket and a second end removably engaged with the second bracket;

wherein the first and second side panels are spaced apart to define a passageway extending through the storage rack and each side panel is formed from a grid of interconnecting substantially horizontal rods and substantially vertical rods.

2. The flue system of claim 1 wherein the passageway extends between a lower end of the storage rack and an upper end of the storage rack.

3. The flue system of claim 1 wherein each bracket includes a substantially U-shaped portion configured for fitting over the respective support beam.

4. The flue system of claim 1 wherein each bracket includes a flange portion, and further wherein the flange portion includes first and second spaced apart slots, each slot for receiving one of the first and second side panels.

5. The flue system of claim 4 wherein a distance between the first and second slots defines a width of the passageway.

6. The flue system of claim 1 wherein an outermost vertical rod at the first end of each side panel is removably engaged with the first bracket and an outermost vertical rod at the second end of each side panel is removably engaged with the second bracket.

7. The flue system of claim 6 wherein a horizontal rod proximate the first and second brackets is supported by a flange portion of each bracket.

8. The flue system of claim 1, and further comprising at least one support hook coupled to an upper end of each side panel, the at least one support hook configured for receiving a lower end of a flue system stacked upon the first and second side panels.

9. The flue system of claim 1, and further comprising a strut extending through the passageway and coupled to the first and second side panels.

10. The flue system of claim 9 wherein the strut provides a hinged coupling between the first and second side panels.

11. A system for conveying smoke through a storage rack, the storage rack including at least two first support beams at a first end of the storage rack and at least two second support beams at a second, opposite end of the storage rack, the support beams spaced apart to define a storage area, the system comprising:

a first flue system including, first and second brackets, the first bracket coupled to a first support beam and the second bracket coupled to a second support beam, a first side panel extending between the first and second ends of the storage rack, the first side panel including a first end removably coupled to the first bracket and a second end removably coupled to the second bracket, and a second side panel extending between the first and second ends of the storage rack, the second side panel including a first end removably coupled to the first bracket and a second end removably coupled to the second bracket, wherein the first and second side panels are spaced apart to define a first passageway extending through a portion of the storage rack;

a second flue system positioned above the first flue system, the second flue system including, first and second brackets, the first bracket coupled to a first support beam and the second bracket coupled to a second support beam, a first side panel extending between the first and second ends of the storage rack, the first side panel including a first end removably coupled to the first bracket and a second end removably coupled to the second bracket, and a second side panel extending between the first and second ends of the storage rack, the second side panel including a first end removably coupled to the first bracket and a second end removably coupled to the second bracket, wherein the first and second side panels are spaced apart to define a second passageway extending through a portion of the storage rack, wherein the first passageway and the second passageway are substantially aligned to define a main passageway; and support means for supporting the second flue system on the first flue system, wherein the support means are coupled to an upper end of the first flue system and are configured for supporting a lower end of the second flue system.

12. The system of claim 11 wherein each bracket includes a substantially U-shaped portion configured for fitting over the respective support beam.

13. The system of claim 11 wherein each bracket includes a flange portion, and further wherein the flange portion includes first and second spaced apart slots, each slot for receiving one of the first and second panels.

14. The system of claim 11 wherein each side panel is formed from a grid of interconnecting substantially horizontal rods and substantially vertical rods.

15. The system of claim 14 wherein for each flue system, a horizontal rod proximate the first and second brackets is supported by a flange portion of each bracket.

16. The system of claim 11 wherein each flue system includes a strut extending through the passageway and coupled to the first and second side panels.

17. The system of claim 11 wherein the support means comprises at least one support hook coupled to the upper end of the first flue system, the at least one support hook configured for receiving the lower end of the second flue system.

18. The system of claim 11 wherein the main passageway extends between a lower end of the storage rack and an upper end of the storage rack.

19. The system of claim 11, and further comprising at least one additional flue system supported by an upper end of the second flue system, the at least one additional flue system extending between the first and second ends of the storage rack and further defining the main passageway.

20. A system for conveying smoke through a storage rack, the storage rack including at least two first support beams at a first end of the storage rack and at least two second support beams at a second, opposite end of the storage rack, the support beams spaced apart to define a storage area, the system comprising:

a first flue system including, first and second brackets, the first bracket coupled to a first support beam and the second bracket coupled to a second support beam, a first side panel extending between the first and second ends of the storage rack, the first side panel including a first end removably engaged with the first bracket and a second end removably engaged with the second bracket, and a second side panel extending between the first and second ends of the storage rack, the second side panel including a first end removably engaged with the first bracket and a second end removably engaged with the second bracket, wherein the first and second side panels are spaced apart to define a first passageway extending through a portion of the storage rack;

a second flue system positioned above the first flue system, the second flue system including, first and second brackets, the first bracket coupled to a first support beam and the second bracket coupled to a second support beam, a first side panel extending between the first and second ends of the storage rack, the first side panel including a first end removably engaged with the first bracket and a second end removably engaged with the second bracket, and a second side panel extending between the first and second ends of the storage rack, the second side panel including a first end removably engaged with the first bracket and a second end removably engaged with the second bracket, wherein the first and second side panels are spaced apart to define a second passageway extending through a portion of the storage rack, wherein the first passageway and the second passageway are substantially aligned to define a main passageway; and support means for supporting the second flue system on the first flue system, wherein the support means are coupled to an upper end of the first flue system and are configured for supporting a lower end of the second flue system.

21. The system of claim 20 wherein each bracket includes a substantially U-shaped portion configured for fitting over the respective support beam.

22. The system of claim 20 wherein each bracket includes a flange portion, and further wherein the flange portion includes first and second spaced apart slots, each slot for receiving one of the first and second panels.

23. The system of claim 20 wherein each side panel is formed from a grid of interconnecting substantially horizontal rods and substantially vertical rods.

24. The system of claim 23wherein for each flue system, a horizontal rod proximate the first and second brackets is supported by a flange portion of each bracket.

25. The system of claim 20 wherein each flue system includes a strut extending through the passageway and coupled to the first and second side panels.

26. The system of claim 20 wherein the support means comprises at least one support hook coupled to the upper end of the first flue system, the at least one support hook configured for receiving the lower end of the second flue system.

27. The system of claim 20 wherein the main passageway extends between a lower end of the storage rack and an upper end of the storage rack.

28. The system of claim 20, and further comprising at least one additional flue system supported by an upper end of the second flue system, the at least one additional flue system extending between the first and second ends of the storage rack and further defining the main passageway.

29. A flue system for use with a storage rack, the storage rack including at least one first support beam at a first end of the storage rack and at least one second support beam at a second, opposite end of the storage rack, the support beams spaced apart to define a storage area, the flue system comprising:

first and second brackets, the first bracket coupled to the first support beam and the second bracket coupled to the second support beam;

a first side panel extending between the first and second ends of the storage rack, the first side panel including a first end removably engaged with the first bracket and a second end removably engaged with the second bracket;

a second side panel extending between the first and second ends of the storage rack, the second side panel including a first end removably engaged with the first bracket and a second end removably engaged with the second bracket; and at least one support hook coupled to an upper end of each side panel, the at least one support hook configured for receiving a lower end of a flue system stacked upon the first and second side panels;

wherein the first and second side panels are spaced apart to define a passageway extending through the storage rack.

30. A flue system for use with a storage rack, the storage rack including at least one first support beam at a first end of the storage rack and at least one second support beam at a second, opposite end of the storage rack, the support beams spaced apart to define a storage area, the flue system comprising:

first and second brackets, the first bracket coupled to the first support beam and the second bracket coupled to the second support beam;

a first side panel extending between the first and second ends of the storage rack, the first side panel including a first end removably engaged with the first bracket and a second end removably engaged with the second bracket;

a second side panel extending between the first and second ends of the storage rack, the second side panel including a first end removably engaged with the first bracket and a second end removably engaged with the second bracket; and a strut extending through the passageway and coupled to the first and second side panels;

wherein the first and second side panels are spaced apart to define a passageway extending through the storage rack.

* * * * *